United States Patent [19]

Denes

[11] 4,134,096

[45] Jan. 9, 1979

[54] TRIMMABLE RESISTOR

[75] Inventor: Oscar L. Denes, Milwaukee, Wis.

[73] Assignee: Allen-Bradley Company, Milwaukee, Wis.

[21] Appl. No.: 850,288

[22] Filed: Nov. 10, 1977

[51] Int. Cl.[2] ..... H01C 10/00

[52] U.S. Cl. ..... 338/195; 338/308; 338/307; 338/320

[58] Field of Search ..... 338/195, 140, 126, 128, 338/320, 306-309; 29/621, 610

[56] References Cited

U.S. PATENT DOCUMENTS

| | | | |
|---|---|---|---|
| 1,962,438 | 6/1934 | Flanzer et al. | 338/142 X |
| 2,759,078 | 8/1956 | Brown | 338/195 X |
| 2,953,764 | 9/1960 | Tellkamp | 338/309 |
| 3,517,436 | 6/1970 | Zandman et al. | 29/613 |
| 3,594,679 | 7/1971 | Seay et al. | 338/195 |

OTHER PUBLICATIONS

Briel et al., Western Electric Technical Digest No. 33, Jan. 74, "Lattice-Type Film Resistor with High Pulse Voltage Tolerance, "p. 21.

Briel et al., Western Electric Technical Digest, "Compact Pattern of Parallel Film Resistors with Uniform Power Dissipation Capability," No. 33, p. 19, Jan. 74.

Bross et al., IBM Technical Disclosure Bulletin, "Modular Resistor Array," vol. 13, No. 5, Oct. 1970, p. 1105.

*Primary Examiner*—C. L. Albritton

*Attorney, Agent, or Firm*—Quarles & Brady

[57] ABSTRACT

A trimmable resistor includes inner and outer resistive strips which are deposited on a base and spaced apart to form a gap. The outer strip is electrically connected at each end to one of a pair of spaced electrical terminals. A plurality of conductive members are spaced apart along the length of the gap and bridge the gap to connect the two resistive strips at a corresponding plurality of locations. The severing of successive frangible conductive members increases the resistance of the trimmer in increments. In a specific embodiment the resistive strips are formed of a cermet material, the base is an alumina substrate, the gap is arcuate, and a thermosetting plastic resin is disposed in the gap to form an insulating buffer pad for each of the frangible conductive members.

13 Claims, 4 Drawing Figures

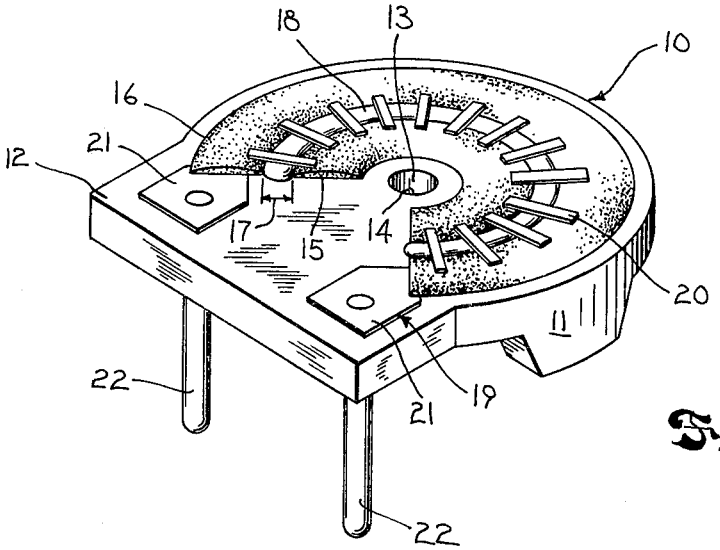
Fig. 1
Fig. 2
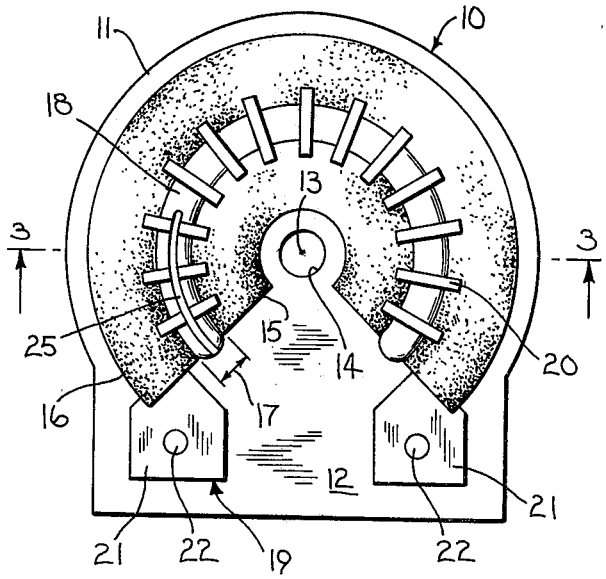
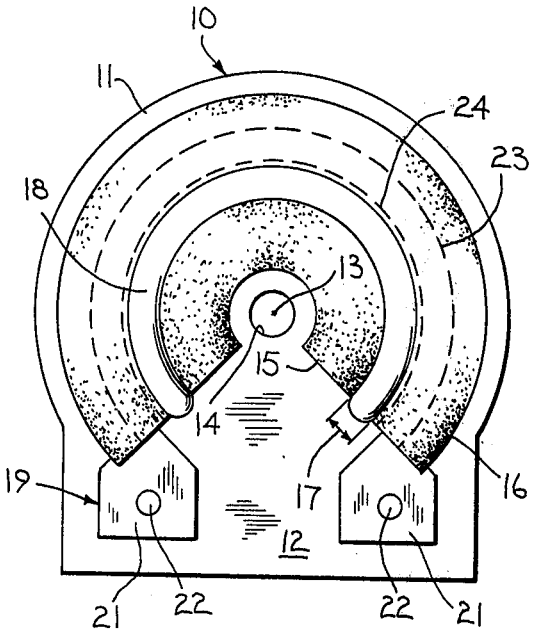
Fig. 4
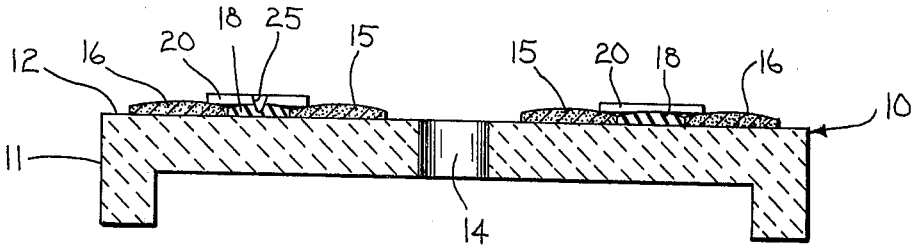
Fig. 3

TRIMMABLE RESISTOR

BACKGROUND OF THE INVENTION

The invention relates to trimmable resistors, sometimes simply called "trimmers." Trimming is the technique of setting the resistance of a variable resistor at a fixed value, usually to be maintained over the operating life of the resistor. Trimmer resistance can be changed in successive trimming operations within a narrowed range between the resistance determined by the previous trimming operation and either the upper or lower limit of resistance, depending on whether trimming increases or decreases resistance.

Trimmers are useful in adjusting the parameters of a general purpose circuit to fit a specific application. One of these parameters might be a reference or bias voltage obtained by dividing a supply voltage across two resistive elements and selecting the output across one of the elements. If the output is taken across a trimmable resistor, the reference or bias voltage can be adjusted by trimming the resistor. Usually, trimming increases resistance; however, resistors which are trimmed to decrease resistance from a nominal value are also available.

Trimmers are well known. Perhaps the most common type includes a resistive layer deposited on a base or substrate, and electrically connected between two electrical termination points to form a conductive path. A scriber or other tool is applied to remove a portion of the resistive layer, thereby forming a nonconductive path which changes the shape of the resistive layer between the termination points. This type of trimmer is disclosed in the Seay et al. U.S. Pat. No. 3,594,679, the Brown U.S. Pat. No. 2,759,078, and the Zandman et al. U.S. Pat. No. 3,517,436.

It is well known by those skilled in the art to form the resistive layer of a trimmer in different shapes. In U.S. Pat. No. 1,962,438 to J. A. Flanzer et al. a method for removing a resistive layer from a disc-shaped resistor is shown and in U.S. Pat. No. 2,953,764 a resistive path is formed in a grid having alternate conductive paths which can be severed to adjust resistance.

The prior art trimmers have two common features. First, in these devices the resistive layer must be removed directly from the substrate. If the substrate is alumina and the resistive layer is cermet, the removal involves penetrating one or both of these two relatively hard materials. Second, the removal is accomplished by scribing a continuous nonconductive path in the resistive layer. This type of trimming adjustment cannot easily be made in predetermined regular increments.

Trimming the prior art devices generally requires relatively sophisticated scribing tools and techniques, which many times can only be applied at the factory. An exception is the device disclosed in a U.S. Pat. No. 4,100,525, which is assigned to the assignee of the present application. There a trimmable resistor is disclosed with a relatively simple scribing tool that can be applied in situ, if desired.

SUMMARY OF THE INVENTION

It is a general object of the invention to provide a resistor which can be easily trimmed in situ in predetermined regular increments.

The invention relates to a trimmable resistor having a base, a pair of spaced terminals mounted on the base for connecting the resistor to an electrical circuit, a pair of resistive strips disposed on the base and spaced apart to define a gap, one of the resistive strips being electrically connected between the pair of terminals, and a plurality of conductive members, each bridging the gap from one resistive strip to the other, at least one of the conductive members being frangible to trim the resistor.

In a specific embodiment the resistive strips are formed of a cermet material, the base is an alumina substrate, the gap between the resistive strips is arcuate, and a thermosetting plastic resin is disposed in the gap to form an insulating buffer pad for each of the frangible conductive members.

One advantage of the present invention is the ease with which the frangible conductive members are severed without penetrating either the cermet resistive layer or the alumina substrate. The frangible conductive members are, on the other hand, durable enough to resist shock and vibration.

Another advantage of the present invention is the protection provided by the insulating buffer pad to the base and to a sharp edge or point of the trimming tool, which would otherwise become dull from the trimming operation. The insulating buffer pad also supports the conductive members, and helps them to withstand shock and vibration.

A further advantage of the present invention is the adaptability of the trimmable resistor to a variety of simple trimming tools, or a scribing tool such as the one disclosed in the U.S. Pat. No. 4,100,525 mentioned above.

Other objects and advantages will become apparent from the description that follows.

BRIEF DESCRIPTION OF THE DRAWINGS

FIG. 1 is a perspective view of a resistor embodying the present invention,

FIG. 2 is a top plan view of the resistor of FIG. 1,

FIG. 3 is a sectional view of the resistor of FIG. 2 taken along the lines indicated, FIG. 4 is a top plan view of the resistor of FIG. 1 with the conductive members removed showing the resulting change in the mean resistive path.

DESCRIPTION OF THE PREFERRED EMBODIMENT

In FIGS. 1 and 2, the trimmable resistor 10 includes a base 11 having a top surface 12, a portion of which is circular about a center 13. The circular portion has a central aperture 14 which begins at the top surface 12 and extends through the base 11. Two arcuate resistive strips 15, 16 are disposed on the base 11 and are spaced apart to define an arcuate gap 17 in which an arcuate strip of insulating material 18 is disposed. The outer resistive strip 16 is connected at each end to one of a pair of spaced terminals 19 which are mounted on the base 11. The inner resistive strip 15 is connected to the outer resistive strip 16 by a plurality of conductive members 20, each bridging the arcuate gap 17 and the insulating material 18. In FIGS. 1 and 3 the thickness of the resistive strips 15, 16, the insulating pad 18, and the conductive members 20 is exaggerated as an aid in disclosing the invention.

The base 11 is an alumina substrate. Alumina materials are well known to those skilled in the art. A method for making a suitable alumina substrate material is disclosed in U.S. Pat. No. 3,329,922. In addition to alumina, other insulating materials can be used to form the base or substrate 11.

The resistive strips 15, 16 are formed by a cermet material which is a matrix of metal and metal oxides dispensed in a glass medium. Cermet materials suitable for use in making the invention are also well known to those skilled in the art. A method for depositing a cermet film on an alumina substrate is disclosed in U.S. Pat. No. 3,887,893. In addition to cermet, the resistive strips may be formed of other suitable materials by known methods.

As seen in FIGS. 1 and 2, the two resistive strips of cermet 15, 16 are formed on the base 11 in arcuate paths of circular curvature having approximately the same width. The inner resistive strip 15 has a mean radius of curvature which is sufficiently less than the mean radius of curvature of the outer resistive strip 16 to form the arcuate gap 17. Preferably, the same angle (e.g., 280°) subtends both arcuate strips 15, 16.

At each of its ends, the outer resistive strip 16 overlaps a film having silver as its primary constituent. The film is fixed on the top surface 12 of the base or substrate 11 at the two spaced terminal locations to form a pair of ohmic contacts 21. A pair of connector pins 22 are mounted on the base 11, each pin 22 extending upward through the base 11 to connect to a respective one of the ohmic contacts 21.

Referring to FIG. 3, the arcuate gap 17 is substantially filled between the resistive strips with an arcuate strip of insulating material 18 which forms a pad beneath each of the conductive members 20. The pad is formed by an arcuate strip as a matter of convenience, and it will be understood by those skilled in the art that it is only necessary that the insulating material 18 substantially fill the portion of the gap 17 beneath the frangible conductive members 20.

The insulating material 18 provides support for the conductive members 20 when they are not being trimmed. The buffer pad of insulating material 18 absorbs the effects of severing the conductive members 20 such as the impact of the trimming tool and the impact of the fragments of the conductive members 20. The pad also prevents the cutting or trimming tool from contacting the base 11.

The insulating material 18 is a mixture of a glass-filled, thermosetting epoxy resin and a vehicle. The epoxy compound, which is 35 percent of the mixture by weight, is sold under the trade symbol 214 B-1, sifted 200 mesh glass fill by Morton-Norwich Products, Inc. of Chicago, Ill. The vehicle, which makes up the remaining 65 percent of the mixture is itself a mixture by weight of 15 percent polysulfone, a thermosetting plastic resin commercially available from Union Carbide Corporation, Chemical and Plastics Division, New York, N.Y., 35 percent acetophenone, and 50 percent dimethyl phthalate.

The insulating material 18 may be applied to the base 11 by a vapor deposition process of the type well known in the art of making film-type electrical components. In contrast to the cermet material which is very hard to cut, the insulating material is relatively softer, and penetrable with ordinary tools having a sharp edge or point. The insulating material 18 is not necessarily penetrable, it can be yieldable or resilient. As used herein, the term "buffer material" or "buffer pad" shall mean a material or pad of any suitable composition that is penetrable, yieldable or resilient.

The conductive members 20 can be formed over the gap to connect the resistive strips 15, 16 by any of the well-known screen printing or vapor deposition processes. A suitable mixture for forming the conductive members 20 by a vapor deposition process is a mixture of 66 percent by weight of a thermosetting epoxy resin with a silver powder filler and 34 percent by weight of the vehicle described in connection with the insulating material 18. The thermosetting resin is a mixture by weight of 73 percent of Engelhard P silver powder, commercially available from Engelhard Minnerals & Chemicals Corporation, Menlo Park, N.J., 9 percent of Silflake 135, another silver powder, commercially available from Handy & Harman, Orange, N.J., and 18 percent of the previously described epoxy resin 214 B-1, sifted 200 mesh glass fill from Morton-Norwich Products, Inc. Chicago, Ill. Many other suitable materials can be used as well. Conductive members 20 formed from the described mixture are sufficiently brittle that they can be severed with a sharp knife or tool.

Referring again to FIG. 2, the conductive members 20 are spaced apart at substantially regular intervals along the length of the gap 17. The resistance between the terminals 19 increases in proportion to an increase in the effective length of the resistive layer connected between them. The resistance between the terminals 19 also increases in proportion to a decrease in the effective cross-sectional area of the resistive layer connected between them. With all of the conductive members intact, this cross-sectional area would be approximately the sum of the average widths of the two resistive strips 15, 16 multiplied by the average thickness of the two resistive strips 15, 16.

FIG. 4 shows an approximate mean effective length 23 for the resistor when all of the conductive members have been severed. Shown inside this path and next to the gap 17 is the approximate mean effective length 24 for the resistor when all of the conductive members are intact. From this it can be seen that in an arcuate-shaped resistive layer with terminals connected to the outer resistive strip 16, the mean effective length will increase slightly as the conductive members 20 are successively interrupted along the length of the gap 17; and therefore, resistance can be expected to increase.

In FIG. 2, the result of a trimming operation is represented by a cut 25 which interrupts three conductive members 20 and penetrates the insulating pad 18. As the frangible conductive members 20 are successively interrupted along the length of the gap 17, a smaller portion of the inner strip is connected between the terminals 19. This has the same effect as decreasing the average width and cross-sectional area of the resistive layer, and thus resistance can be expected to increase.

These expectations have been confirmed by testing two trimmers of the type described herein with nominal values of 500Ω and 10K, respectively. The results of interrupting the conductive path through each frangible member in succession from one end of the gap to the other in those trimmers are summarized in Table 1.

TABLE 1

| Member Interrupted | Trimmed Resistance 500Ω (nominal) Resistor (Ω) | Trimmed Resistance 10 K (nominal) Resistor (KΩ) |
|---|---|---|
| 0 (actual value | 532 | 13.15 |
| 1 | 581 | 14.63 |
| 2 | 634 | 16.08 |
| 3 | 683 | 17.52 |
| 4 | 730 | 19.00 |
| 5 | 775 | 20.68 |
| 6 | 824 | 22.55 |
| 7 | 873 | 24.27 |
| 8 | 919 | 25.87 |

TABLE 1-continued

| Member Interrupted | Trimmed Resistance 500Ω (nominal) Resistor (Ω) | 10 K (nominal) Resistor (KΩ) |
|---|---|---|
| 9 | 967 | 26.31 |
| 10 | 1010 | 27.55 |
| 11 | 1051 | 28.53 |
| 12 | 1082 | 29.27 |
| 13 | 1094 | 29.59 |
| 14 | 1095 | 29.59 |

The frangible conductive members were disposed between the resistive strips along the length of the gap at substantially regular intervals, and it can be seen that by interrupting them in succession substantially equal increases in resistance can be obtained. If the conductive members are severed out of sequence then resistance will increase but not necessarily in substantially equal increments. A secondary observation is that severing the last conductive member has no effect on the resistance because at least two members are required to electrically connect the two resistive strips. Therefore, at least one of the conductive members need not be frangible, and in fact, some embodiments may include more than one nonfrangible conductive member.

The interruption, severing or trimming of the conductive members can be done with a special trimming tool such as that shown in U.S. Pat. No. 4,100,525. For the purpose of receiving and situating this type of tool, and for manufacturing purposes, the central aperture 14 is provided. Trimming can also be accomplished with other tools for which the trimming of this resistor is an ancillary function.

For the purposes of description the conductive members 20 have been described as "frangible" and a specific embodiment has been described in which the conductive members are formed by a readily severable material. It is intended, however, that the term "frangible" not be so limited, but will be understood to include conductive members which are interruptible by any means or mechanism whether or not it functions to sever the members in the normal sense.

And although the invention has been described with reference to one embodiment, it will be understood by those skilled in the art that the invention is capable of a variety of embodiments. For example, the insulating pad is preferred, but it is not necessary to the practice of the invention in all embodiments, particularly if the base is made of a plastic material. The resistive strips can be formed in a variety of configurations and may be nonparallel, rectilinear, or tapered in width or thickness to provide coarse trimming adjustment. Therefore, reference should be made to the following claims for the scope of the invention.

I claim:

1. A trimmable resistor, which comprises:

a base;

a pair of spaced terminals mounted on the base for connecting the resistor to an electrical circuit;

a pair of resistive strips disposed on the base and spaced apart to define a gap, one of the resistive strips being electrically connected between a pair of terminals;

a plurality of conductive members, each bridging the gap from one resistive strip to the other, at least one of the conductive strips being frangible to trim the resistor; and an insulating buffer material disposed in the gap below each frangible conductive member.

2. The trimmable resistor of claim 1 wherein the gap is arcuate.

3. The trimmable resistor of claim 1 wherein the conductive members are spaced apart along the length of the gap at substantially regular intervals.

4. The trimmable resistor of claim 2 wherein the conductive members are spaced apart along the length of the gap at substantially regular intervals.

5. A trimmable resistor for in situ trimming adjustment in substantially equal increments, which comprises:

a base;

a pair of spaced terminals mounted on the base for connecting the resistor to an electrical circuit;

a pair of resistive strips disposed on the base and spaced apart to define a gap, one of the resistive strips being electrically connected between the pair of terminals;

a plurality of conductive members spaced apart along the length of the gap, each conductive member bridging the gap from one resistive strip to the other, at least one of the conductive members being frangible; and an insulating buffer material disposed in the gap below each frangible conductive member for absorbing the effects of severing the conductive members.

6. The trimmable resistor of claim 5, wherein the gap is arcuate.

7. The trimmable resistor of claim 5 wherein the conductive members are spaced apart along the gap at substantially regular intervals.

8. The trimmable resistor of claim 6 wherein the conductive members are spaced apart along the gap at substantially regular intervals.

9. A trimmable resistor for in situ trimming adjustment in substantially equal increments, which comprises:

a substrate;

a pair of spaced terminals mounted on the substrate for connecting the resistor to an electrical circuit;

a pair of arcuate cermet resistive strips deposited on the base and spaced apart to define an arcuate gap, an outer resistive strip being electrically connected between the pair of terminals;

a plurality of frangible conductive members spaced apart along the length of the gap at substantially regular intervals, each conductive member bridging the gap from one resistive strip to the other; and an arcuate strip of insulating buffer material disposed on the substrate and substantially filling the gap for supporting the frangible members and absorbing the effects of severing the frangible members.

10. The trimmable resistor of claim 9 wherein the insulating buffer material is made from a mixture which includes a glass-filled, thermosetting epoxy resin.

11. The trimmable resistor of claim 9 wherein the conductive members are made from a mixture including a glass-filled thermosetting epoxy resin, and a silver powder filler.

12. A trimmable resistor for trimming adjustment in predetermined increments, which comprises:

a base;

a pair of spaced terminals mounted on the base for connecting the resistor to an electrical circuit;

a pair of resistive strips disposed on the base and spaced apart to define a gap, one of the resistive strips being electrically connected between the pair of terminals; and at least three conductive members spaced apart along the length of a gap, each conductive member bridging the gap from one resistive strip to the other, a plurality of the conductive members being frangible to trim the resistor in predetermined increments.

13. A trimmable resistor for in situ, incremental trimming adjustment, which comprises:

a base having a central aperture therein for locating a trimming tool;

a pair of spaced terminals mounted on the base for connecting the resistor to an electrical circuit;

a pair of arcuate resistive strips disposed on the base and spaced apart to define an arcuate gap, one of the resistive strips being electrically connected between a pair of terminals; and at least three conductive members spaced apart along the length of the gap, each conductive member bridging the gap from one resistive strip to the other, a plurality of the conductive members being frangible to trim the resistor in increments that are proportional to the spacing between the conductive members when the conductive members are interrupted in succession.

* * * * *

UNITED STATES PATENT OFFICE

CERTIFICATE OF CORRECTION

Patent No. 4,134,096 Dated January 9, 1979

Inventor(s) Oscar L. Denes

It is certified that error appears in the above-identified patent and that said Letters Patent are hereby corrected as shown below:

| | |
|---|---|
| Column 4, line 21 | "increase" should be underscored or italicized |
| Column 4, line 24 | "decrease" should be underscored or italicized |
| Column 4, Table 1 | after "value" a close parenthesis should appear |
| Claim 5<br>Column 6, line 11 | "in situ" should be underscored or italicized |
| Claim 9<br>Column 6, line 39 | "in situ" should be underscored or italicized |
| Claim 13<br>Column 7, line 11 | "in situ" should be underscored or italicized |

Signed and Sealed this

*Twelfth* Day of *June 1979*

[SEAL]

*Attest:*

RUTH C. MASON
*Attesting Officer*

DONALD W. BANNER
*Commissioner of Patents and Trademarks*